US009550661B2

(12) United States Patent
St-Germain et al.

(10) Patent No.: US 9,550,661 B2
(45) Date of Patent: Jan. 24, 2017

(54) SELF-CONTAINED, PORTABLE AND SELF-SUPPORTING SCAFFOLDING KIT

(71) Applicants: Fiducie Familiale André St-Germain, St-Bonaventure (CA); Fiducie Familiale Poulin, St-Simon-de-Bagot (CA)

(72) Inventors: André St-Germain, St-Hyacinthe (CA); Gilles Poulin, St-Hyacinthe (CA)

(73) Assignees: FIDUCIE FAMILIALE ANDRE ST-GERMAIN, St-Hyacinthe, Quebec (CA); FIDUCIE FAMILIALE POULIN, St-Simon-de-Bagot, Quebec (CA)

( * ) Notice: Subject to any disclaimer, the term of this patent is extended or adjusted under 35 U.S.C. 154(b) by 126 days.

(21) Appl. No.: 14/089,430

(22) Filed: Nov. 25, 2013

(65) Prior Publication Data

US 2014/0144724 A1 May 29, 2014

Related U.S. Application Data

(60) Provisional application No. 61/729,468, filed on Nov. 23, 2012.

(51) Int. Cl.

| | |
|---|---|
| ***E04G 1/20*** | (2006.01) |
| ***B66F 11/04*** | (2006.01) |
| ***E04G 1/34*** | (2006.01) |
| *E04G 1/24* | (2006.01) |

(52) U.S. Cl.

CPC ..... *B66F 11/04* (2013.01); *E04G 1/20* (2013.01); *E04G 1/34* (2013.01); *E04G 2001/242* (2013.01)

(58) Field of Classification Search

CPC ..... E04G 1/20; B66C 23/283; B66F 11/04; B66B 9/16

USPC ..... 182/101, 69.6, 63.1, 62.5, 115, 141, 182/178.1, 178.3, 178.4, 178.5, 178.6

See application file for complete search history.

(56) References Cited

U.S. PATENT DOCUMENTS

| | | | | | |
|---|---|---|---|---|---|
| 3,472,337 | A * | 10/1969 | Atchey | 182/2.7 |
| 3,907,066 | A * | 9/1975 | Newton | 182/112 |
| 4,068,737 | A * | 1/1978 | Lenz | 182/69.6 |
| 4,293,054 | A * | 10/1981 | Pieri | 182/69.6 |
| 4,294,332 | A * | 10/1981 | Ready | 182/141 |
| 4,498,556 | A * | 2/1985 | Garton | 182/19 |
| 4,809,814 | A * | 3/1989 | St-Germain | 182/132 |
| 5,067,587 | A * | 11/1991 | Mims et al. | 182/69.6 |
| 5,579,865 | A * | 12/1996 | Butler et al. | 182/141 |
| 5,823,291 | A * | 10/1998 | Goldbach | 182/141 |
| 6,186,273 | B1 * | 2/2001 | Goldbach et al. | 182/128 |
| 7,607,513 | B1 * | 10/2009 | Rojas | 182/20 |
| 2003/0213647 | A1 * | 11/2003 | St-Germain | 182/141 |
| 2004/0020717 | A1 * | 2/2004 | Robillard | 182/141 |
| 2004/0104073 | A1 * | 6/2004 | Ingle | 182/141 |
| 2008/0230321 | A1 * | 9/2008 | Csaszar et al. | 187/244 |
| 2013/0112500 | A1 * | 5/2013 | Keersmaekers | 182/14 |

* cited by examiner

*Primary Examiner* — Alvin Chin-Shue
*Assistant Examiner* — Shiref Mekhaeil
(74) *Attorney, Agent, or Firm* — Equinox IP

(57) ABSTRACT

A self-contained portable self-supporting scaffolding kit for mounting adjacent an elevated structure and allowing a user to reach the elevated structure to work thereon. The kit includes a movable base assembly that supports a tower assembly along which a platform assembly moves, in a use configuration. In a portable configuration, the kit is partially disassembled, folded and secured on the base assembly for transportation thereof, with all required equipment pieces.

13 Claims, 5 Drawing Sheets

SELF-CONTAINED, PORTABLE AND SELF-SUPPORTING SCAFFOLDING KIT

CROSS-REFERENCE TO RELATED APPLICATIONS

Benefit of priority of U.S. Provisional Application for Patent Ser. No. 61/729,468, filed on Nov. 23, 2012, incorporated herein by reference, is hereby claimed.

FIELD OF THE INVENTION

The present invention relates to scaffoldings, and more specifically to a self-contained portable and self-supporting scaffolding kit, with easy-to-use and high safety features.

BACKGROUND OF THE INVENTION

Scaffoldings with raisable platform mounted on a tower or the like are well known in the art of building construction. These scaffoldings require the tower to be temporarily secured to the adjacent structure at a relatively low height, starting at about 20 feet from ground, when carrying substantial loads. These attachments require the help of skilled technicians and prevent the scaffolding from being rapidly displaced from one place to another whenever required. Furthermore these types of scaffoldings usually include massive and heavy sections of towers in order to carry significant loads with a relatively small size cross section.

There is no existing 'portable' size scaffoldings in which the overall structure is relatively light weight for self-support while being easily assembled and/or disassembled by a single worker, and still allowing for the worker being on the vertically displaceable platform to be capable of displacing himself/herself all along the platform through the tower.

Furthermore, existing scaffoldings always require significant amount of equipment that usually need to be carried independently from the scaffolding itself, such that either many back and forth displacements between two points are required or many motor vehicles are used to carry them all. Alternatively, a single truck with a large loading platform could be used, but such a truck would have limited access to construction areas and typically requires a skilled and licensed driver.

Similarly, existing non-raisable scaffoldings, in order to cover a surface of approximately 40 feet wide by 32 feet high (about 12x10 meters), requires about 4 hours to be fully installed by a minimum of two skilled workers, before use.

Accordingly, there is a need for an improved self-contained portable self-supporting scaffolding kit.

SUMMARY OF THE INVENTION

It is therefore a general object of the present invention to provide an improved self-contained portable self-supporting scaffolding kit.

An advantage of the present invention is that the scaffolding kit is relatively simple and inexpensive to manufacture.

Another advantage of the present invention is that the self-supporting scaffolding of the kit does not require to be anchored to an adjacent building structure, up to a total height of the scaffolding equivalent to about a maximum of a 4-story high building.

A further advantage of the present invention is that the self-supporting scaffolding kit is portable such that, when into an unassembled configuration it could be part of a trailer or the like for motor vehicle.

Still another advantage of the present invention is that the self-supporting scaffolding kit is easily assembled/disassembled and installed by a single worker, being alone with no help.

Yet another advantage of the present invention is that the self-supporting scaffolding kit is fully safe for any worker and does not require any special skill for the operation, including assembly and disassembly, of the scaffolding.

Still another advantage of the present invention is that the self-supporting scaffolding kit may include different working equipment, such as a crane assembly located on top of the tower assembly, adjustable platforms and/or extensions thereof, all this working equipment being carryable on the same trailer as of the scaffolding, to provide for a self-contained portable kit.

Another advantage of the present invention is that the self-supporting scaffolding kit does not require the use of any ladder or the like to get on and off from the platform temporarily locked at any specific height since the tower itself includes the ladder to allow a user to climb along and inside the supporting tower.

A further advantage of the present invention is that the self-supporting scaffolding kit can be easily customized to provide pre-determined features to specific users, wherever desired.

According to an aspect of the present invention there is provided a self-contained portable self-supporting scaffolding kit for mounting adjacent an elevated structure and allowing a user to reach the elevated structure to work thereon, said kit comprising:

a support base assembly;

a tower assembly releasably mounting on the support base assembly, the tower assembly including a plurality of tower sections releasably attaching to and on top of one another in an end-to-end configuration, a lowermost said tower section releasably attaching to the support base, each said tower section having two opposite lateral sides with facing openings for allowing a user to move through said tower section via said facing openings; and a platform assembly being movably mounted on the tower assembly for displacement therealong, the platform assembly including a sleeve member mounting around the tower assembly, and a platform member connecting to the sleeve member, the platform member being movable between a portable configuration with the platform member being adjacent and substantially parallel to the sleeve member and the tower assembly, and a use configuration with the platform member extending substantially perpendicular to the sleeve member and the tower assembly.

Conveniently, each tower section has a rectangular, and preferably square cross-section.

Conveniently, for each tower section, the two opposite lateral sides are connected to one another via a font side and a rear side, at least one of the front and rear sides includes a ladder member.

Typically, the platform member extends on opposite sides of the sleeve member and generally perpendicularly to the lateral sides of the tower sections In one embodiment, the platform member hingeably connects to the sleeve member.

Conveniently, the platform member includes two half portions hingeably connecting to one another.

Conveniently, the platform assembly includes a plurality of holes slidably receiving a respective plank support beam, the plank support beam laterally protruding from the platform member for supporting a side platform extension thereon.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE INVENTION

With reference to the annexed drawings the preferred embodiment of the present invention will be herein described for indicative purpose and by no means as of limitation.

Referring to FIGS. 1 through 4, there is shown a self-contained and portable self-supporting scaffolding kit 10 in accordance with an embodiment of the present invention. The term portable means a scaffolding kit that can easily be carried on a trailer by a motorized vehicle and easily assembled/disassembled by a single worker, and that is not required to be secured to an adjacent building structure S or the like when being used as its overall maximum height is in the order of a four (4) story high building.

Figures 1, 1A:
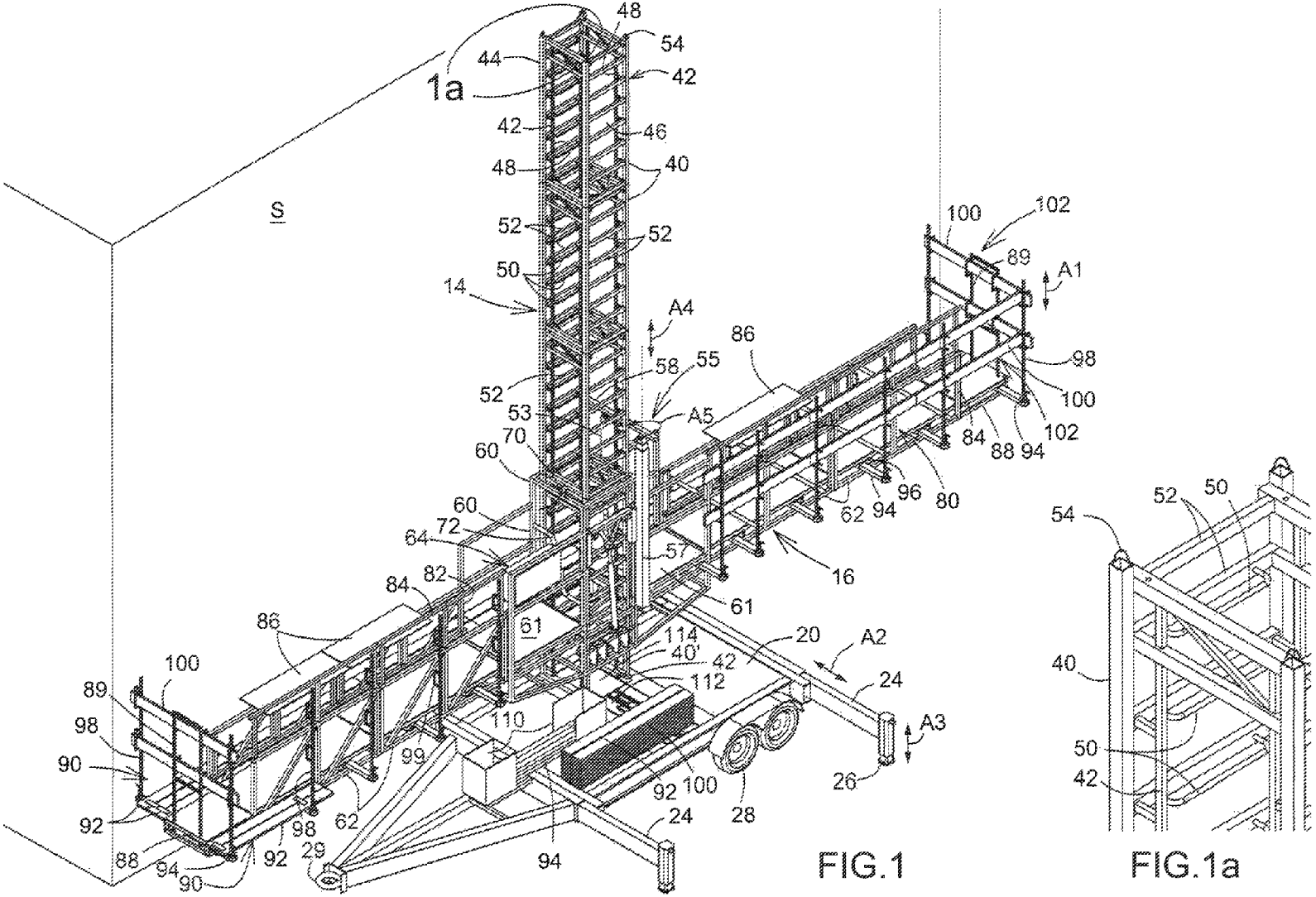
FIG. 1 is a simplified schematic perspective view of a self-contained, protable and self-supporting scaffolding kit in accordance with an embodiment of the present invention in the use configuration.
FIG. 1*a* is an enlarged partially sectioned perspective view taken along line 1 a of FIG. 1.
Figure 2:
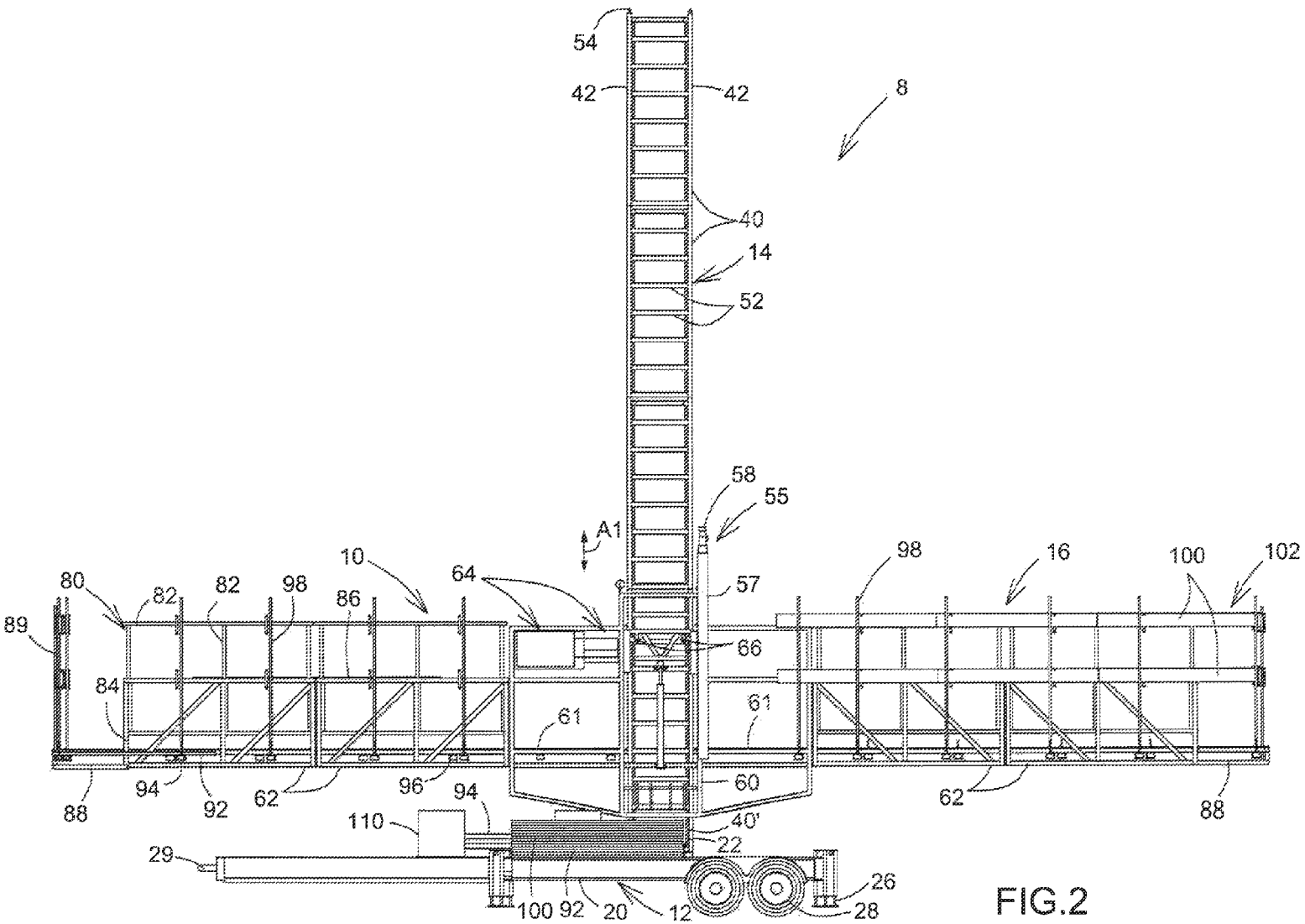
FIG. 2 is a simplified schematic rear elevation view of the embodiment of FIG. 1 in the use configuration.
Figure 4:
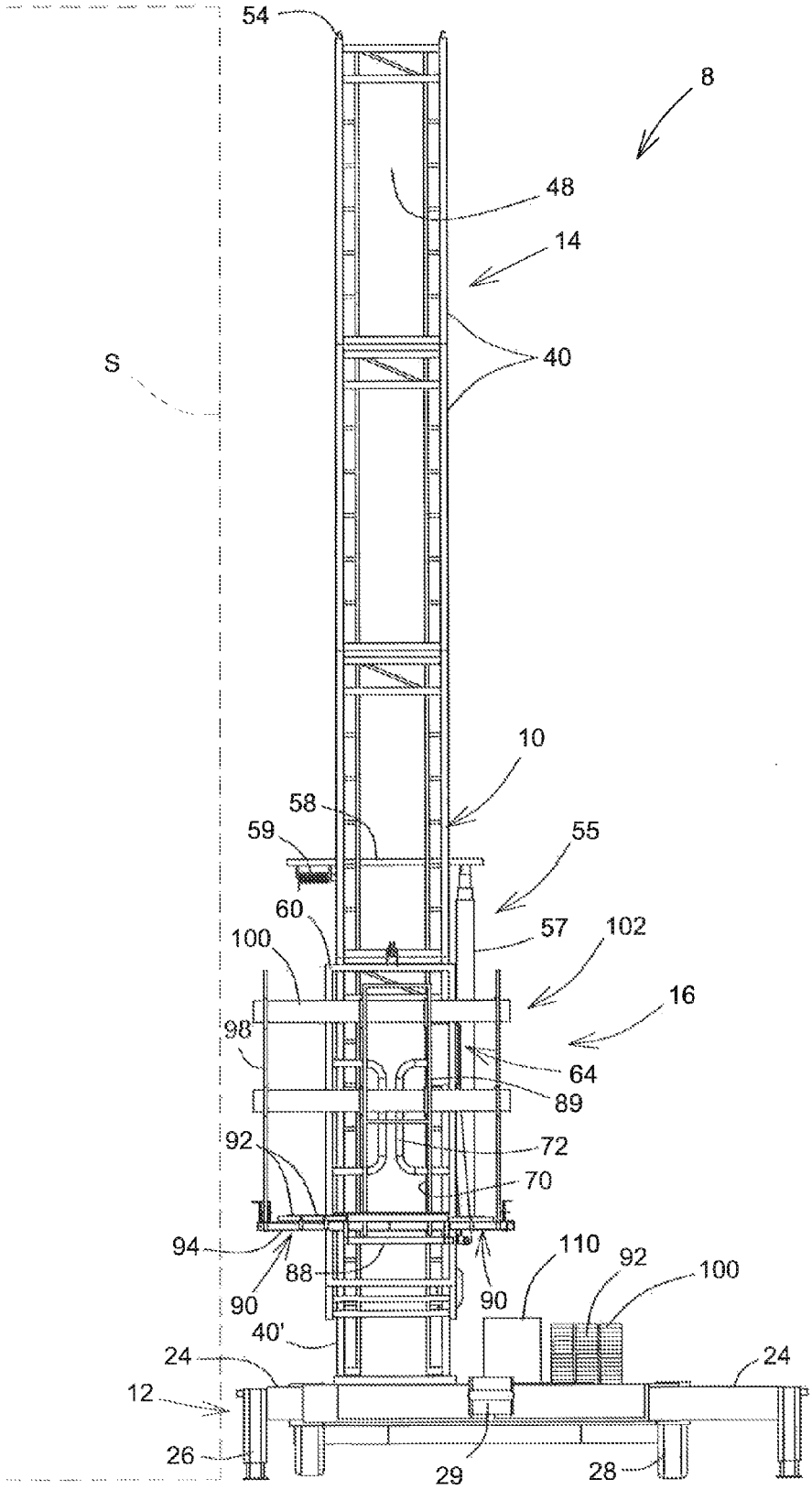
FIG. 4 is a simplified schematic side elevation view of the embodiment of FIG. 1, in the use configuration.

The self-contained and portable self-supporting scaffolding kit 8, shown in the use configuration in FIGS. 1, 2, and 4, includes self-supporting scaffolding 10 that comprises a support base assembly 12, a tower assembly 14 mounting on and attaching to the support assembly 12 and a platform assembly 16 movably (slidably) mounting on the tower assembly 14, as illustrated by arrow A1. The support assembly 12 is typically formed of a base member 20, preferably heavy (in the order of about 3000-4000 lb, about 1500-2000 kg, for example), generally in the form of closed structure of steel beams filled with concrete or the like having a tower attachment structure 22 protruding upwardly therefrom, and a plurality of laterally extendable (preferably lengthwise, as illustrated by arrow A2) mounting legs or outriggers 24 and high adjustable (as illustrated by arrow A3) feet 26 for stability of the scaffolding 10. The base assembly 12 is typically mounted on wheels 28 for displacement thereof, along with a hitch assembly 29 or the like. Accordingly, the height adjustment of the feet 26 allow to raise the scaffolding 10 such that it is properly horizontally levelled and supported by the four legs 24 only, and not the wheels 28, when being used.

The tower assembly 14 typically includes a plurality of tower sections 40 releasably attaching to and on top of one another in an end-to-end configuration. A lowermost tower section 40' releasably attaches to the attachment structure 22 of the support base assembly 12. Each tower section 40 has two opposite lateral sides 42, a front side 44 typically for facing a building structure S or the like, and an opposite rear side 46. Each tower section 40, 40' typically has a rectangular, and preferably square cross section (typically about 3.5 feet or 1 meter of side width). Each lateral side 42 has an opening 48 adapted to face the corresponding opening 48 of the opposite lateral side 42 to allow a user of the scaffolding kit 8 to move through the tower section 40 via the facing openings 48.

In order to allow the users/workers to access the platform assembly 16, at least the front side 44 of the each tower section 40 typically includes a series of ladder extensions or steps 50 inwardly protruding from generally horizontal cross bars 52 thererof, as better shown in FIG. 1*a*. Each tower section 40 includes an alignment feature 54 at its upper end to enable the proper alignment of the adjacent upper tower section 40 during assembly, and is releasably secured to the adjacent upper tower section 40 using conventional bolts (not shown) or the like.

Figure 3A:
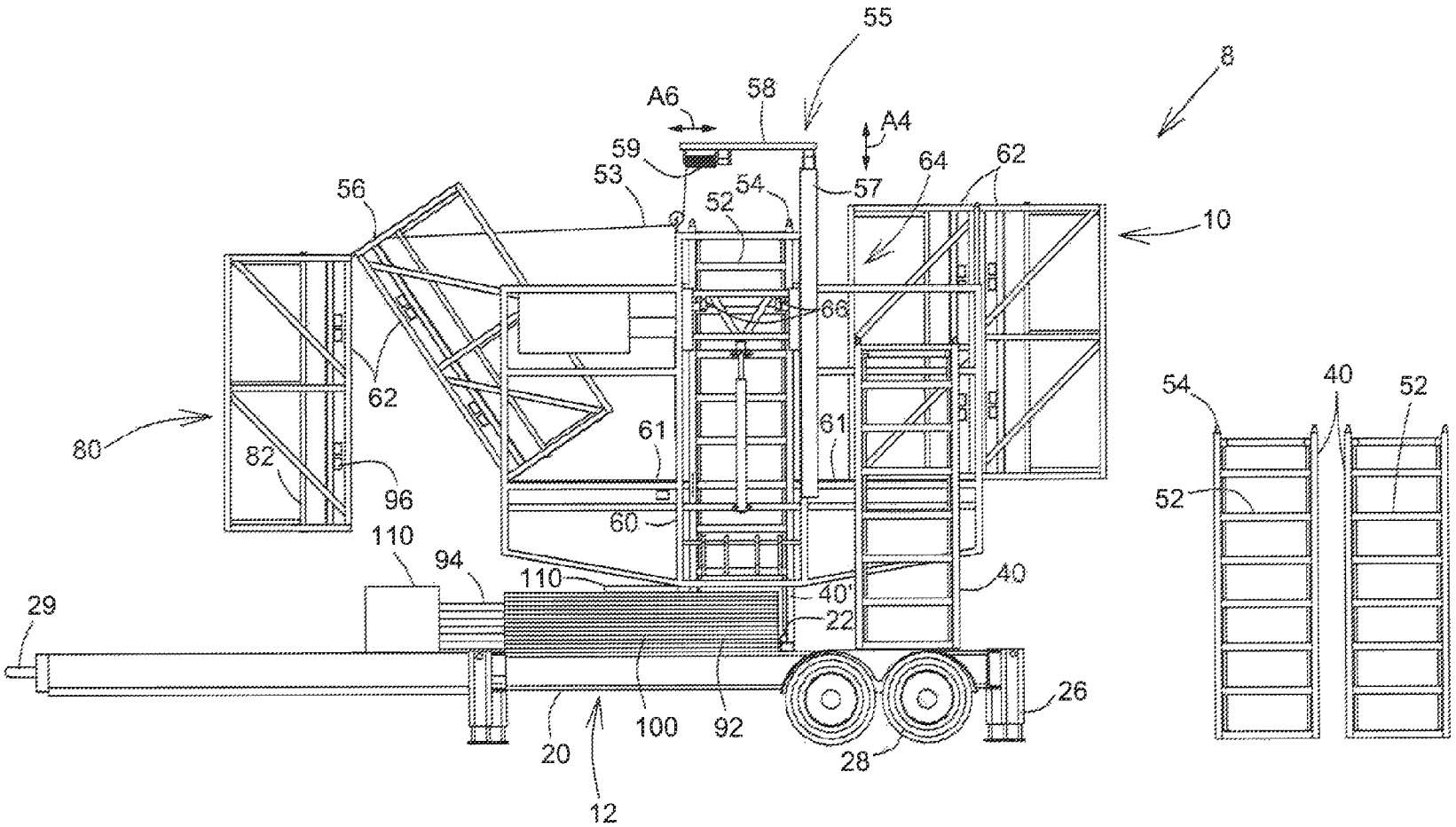
FIG. 3*a* is a simplified schematic rear elevation view of the embodiment of FIG. 1, shown with most equipment pieces.
Figure 3B:
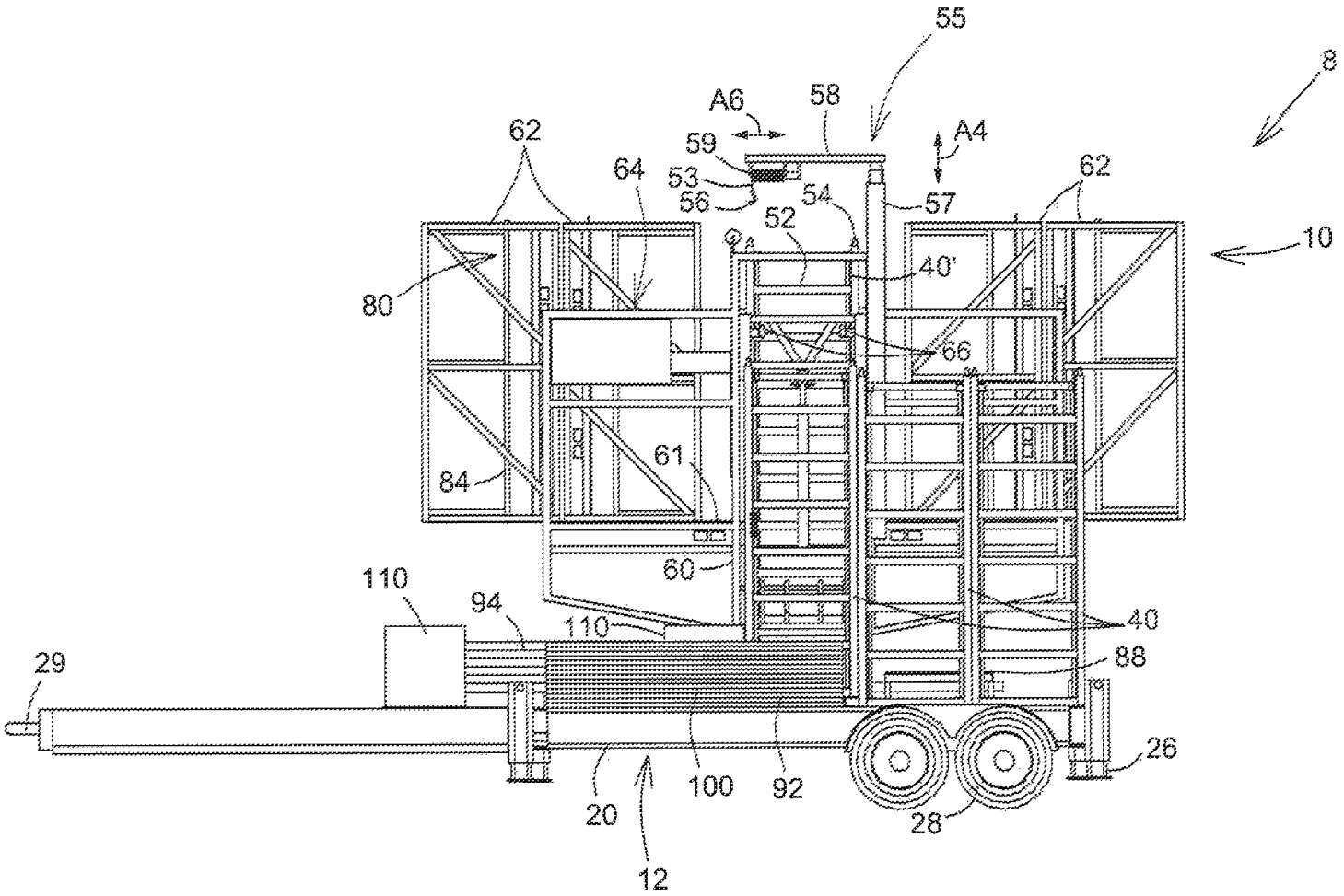
FIG. 3*b* is a view similar to FIG. 3*a*, showing the embodiment in the portable configuration.

The platform assembly 16 typically includes a sleeve member 60 mounting around the tower assembly 14 and a platform member 62 movably securing to a platform base 61 of the sleeve member 60, at a lower end thereof and laterally extending therefrom, preferably on both sides, for structural equilibrium reasons, as shown in FIGS. 3*a* and 3*b*. The sleeve member 60 typically includes a crane 55 carrying a wire cable 53 usually ending with a hook 56. In order to have the required flexibility to lift a tower section 40 for securing it on top of the previous tower section 40, the crane 55 typically includes a telescopic vertical boom 57 (as illustrated by arrow A4) rotatably supporting a horizontal boom 58 (as illustrated by arrow A5) on which the motor/reel assembly 59 of the wire cable 53 is slidably mounted (as illustrated by arrow A6). The crane 55, in addition to be used for the assembly and disassembly of the self-supporting scaffolding 10, is also used for the folding and unfolding of the hinged platform members 62 (as shown in FIGS. 3*a* and 3*b*), and for the raising of equipment, material or the like (not shown) onto the platform assembly 16. The platform member 62 typically extends on opposite sides of the sleeve member 60 and generally perpendicularly to the lateral sides 42 of the tower sections 40.

As shown in FIGS. 1 to 4, the sleeve member 60 is secured to the tower assembly 14 via a lifting mechanism 64 generally located on a rear side thereof for axial displacement relative thereto. The lifting mechanism 64 includes an electrically or hydraulically powered hook member 66 interfacing with the series of horizontal cross bars 52 of the rear side 46 of the tower sections 40. The sleeve member 60 slides along the tower assembly 14 using sliding guide tabs (not shown) abutting against the four (4) corners of tower assembly 14, typically at both the upper and lower ends of the sleeve member 60. The sleeve member 60 also includes a safety stop mechanism (not shown) known in the art to prevent inadvertent free falling of the sleeve member 60 along the tower assembly 14. The safety stop mechanism, typically biased to engage one of the cross bars 52, is typically selectively disengageable from the tower assembly 14 when the hook member 66 is engaged with one of the cross bars 52, for allowing the displacement of the sleeve member 60 along the tower assembly 14. Furthermore, two apertures 70 are defined on lateral sides of the sleeve member 60 to clear off the space between the upper and lower ends thereof. The apertures 70, when in register with the facing openings 48 of a corresponding tower section 40, allow for a worker to step therethrough, in a generally standing position, from one lateral side of the tower assembly 14 to the other, on the platform member 62. For safety purposes, each aperture 70 typically includes a pair of spring doors 72 or the like, for automatic closing thereof, preferably openable towards the respective platform member 62.

In the embodiment shown throughout the Figures, the platform member 62 are located on each side of the sleeve member 60 and are typically hingeably mounted onto the platform base 61. Each side of the platform member 62 is further divided, lengthwise, into two half portions that are hingeably connected to one another such that, when in the portable configuration shown in FIG. 3*b*, both half portions are with their bottom sides facing one another. The handrails 80 of the platform members 62 include a foldable upper portion 82 hingeably mounted onto a corresponding fixed lower portion 84. The upper portions 82 are foldable to allow for a more compact portable configuration of the scaffolding 10, and to allow the installation of a working table 86 whenever required, to carry construction material as bricks and the like at a suitable height for the workers, as best seen in FIG. 1. Platform end members 88 at the extremities, with their respective hand rail 89, allow for the users/workers to freely move between the platform member 62 and temporary and customizable front and/or rear side platform extensions 90. The platform extensions 90 are typically provided with wooden planks 92 or the like supported by plank support beams 94 slidably inserted into corresponding holes 96 provided underneath the platform members 62. The width of each platform extension 90 may vary from nothing to about six (6) feet (2 meters), about six to ten wooden planks 92 side by side, such that the overall width of the scaffolding 10 could be as wide as about sixteen (16) feet (5.5 meters). The free end of each plank support beam 94 typically releasably receives a hand rail post 98, itself adapted to slidably receive, into slots 99, side rail planks 100 that form the protective hand rail 102, which is not required when the corresponding platform extension 90 does face the building structure S or the like.

When in the self-contained portable configuration, as shown in FIG. 3*b*, the slidable plank support beams 94 are typically stacked on the base member 20 between stoppers 110, while the wooden planks 92, 100 are typically stacked on the base member 20 beside the plank support beams 94. The two platform end members 88 are typically located on the base member 20 beneath the respective retracted platform member 62 secured in the portable configuration. All other small equipment are typically located into a recess 112, provided with closing panels 114 or the like (see FIG. 1), centrally located on the base member 20 under the tower assembly 14. The adjustable feet 26 are raised and the mounting legs 24 are retracted into their portable configuration Two (2) of the three (3) tower sections 40 are located on the rear side of the base member 20 while the other one is located on the wooden planks 92, 100 beside the sleeve member and the lowermost tower section 40' secured to the base member 20. All equipment is properly secured to the base assembly 12, using straps or the like (not shown) well-known in the art, to allow for its safe transportation.

When fully assembled in the use configuration, as shown in FIGS. 1, 2, and 4, with three tower sections 40 mounted on top on the lowermost section 40', the self-supporting scaffolding 10 essentially covers a working wall surface of an adjacent building structure S of about 40 feet (12 meters) long by 32 feet (10 meters) high.

Although not illustrated, the self-supporting scaffolding kit 8 could eventually be used with about ten (10) additional tower sections 40 (other than the four (4) sections shown in the drawings), to reach higher adjacent structures, such as up to about 10 or 12-story high buildings or bridges or the like. In such cases, the uppermost tower section 40 would need to be anchored onto the adjacent structure, in a manner well known in the art, and the support base assembly 12, or trailer, would also need to be anchored either to the adjacent structure or to adjacent heavy blocks of concrete or the like, in order to prevent potential accidental tilting of the tower assembly 14 or displacement of the support base assembly 12. Similarly, although not shown, the base assembly 12, could simply be a heavy concrete block provided with a tower attachment structure 22 to securely receive the tower assembly 14 of the self-supporting scaffolding 10 thereon.

Although the present invention has been described with a certain degree of particularity, it is to be understood that the disclosure has been made by way of example only and that the present invention is not limited to the features of the embodiments described and illustrated herein, but includes all variations and modifications within the scope of the invention as hereinafter claimed.

We claim:

1. A self-contained portable self-supporting scaffolding kit for mounting adjacent an elevated structure and allowing a user to reach the elevated structure to work thereon, said kit comprising:

a support base assembly mounted on wheels, said support base assembly including a hitch assembly and forming a trailer;

a tower assembly releasably mounting on the support base assembly, the tower assembly defining a longitudinal axis and including therealong a plurality of tower sections releasably attaching to and on top of one another in an end-to-end configuration, a lowermost tower section of said plurality of tower sections releasably attaching to the support base assembly, each one of said tower sections having two opposite lateral sides each having an opening extending therethrough, for each one of said tower sections, said opening of one of said lateral sides being in alignment with and facing said opening of the other one of said lateral sides; and a platform assembly being movably mounted on the tower assembly for displacement therealong, the platform assembly including a sleeve member mounting around the tower assembly, and a platform member connecting to the sleeve member and extending therefrom in a direction away from at least one of said lateral sides of said plurality of tower sections of the tower assembly, the sleeve member defining opposite sleeve lateral sides thereof generally parallel to the lateral sides of the tower assembly, each one of said sleeve lateral sides having an aperture extending therethrough, said aperture of one of said sleeve lateral sides being in alignment with and facing said aperture of the other one of said sleeve lateral sides, each said aperture and each one of said openings being configured to allow a user to walk through said openings of said opposite lateral sides of said tower sections and said apertures of said sleeve lateral sides of said sleeve member across the sleeve lateral sides and said lateral sides of one of said tower sections, the platform member having a platform surface being generally planar, the platform member being configured for moving along said tower assembly between a portable configuration with the platform surface being adjacent and substantially parallel to both the sleeve member and the longitudinal axis of the tower assembly, and a use configuration with the platform surface being substantially perpendicular to both the sleeve member and the longitudinal axis of the tower assembly, the sleeve member further including a door selectively closing each one of said apertures.

2. The scaffolding kit of claim 1, wherein, for each one of said tower sections, the two opposite lateral sides are connected to one another via a font side and a rear side, at least one of the front and rear sides including a ladder member inwardly protruding therefrom towards the other one of the front and rear sides, the two opposite lateral sides and the front and rear sides defining a cross-section area therebetween having a size being configured to allow a user to move up and down along and inside the tower section.

3. The scaffolding kit of claim 1, wherein said platform member extends from the sleeve member in a direction away from each one of said lateral sides of said plurality of tower sections of the tower assembly.

4. The scaffolding kit of claim 3, wherein the platform member includes, on each one of said sleeve lateral sides, two longitudinal half portions hingeably connecting to one another.

5. The scaffolding kit of claim 4, wherein, on each one of said sleeve lateral sides, the two longitudinal half portions of the platform member hingeably connect to one another and define a bottom side thereof, the bottom side of each one of the two longitudinal half sections facing one another into an accordion-like fashion along and against the sleeve member when in the portable configuration.

6. The scaffolding kit of claim 1, wherein each one of said tower sections has a rectangular cross-section.

7. The scaffolding kit of claim 6, wherein said rectangular cross section is a square cross-section.

8. The scaffolding kit of claim 1, wherein the platform member directly hingeably connects to the sleeve member.

9. The scaffolding kit of claim 1, wherein the platform assembly includes a plurality of holes slidably receiving a respective plank support beam, said plank support beam laterally protruding from the platform member and releasably supporting a side platform extension thereon.

10. The scaffolding kit of claim 1, wherein the platform member includes handrails extending upwardly from the platform surface, said handrails having a fixed lower section and an upper section movably mounted onto the fixed lower section.

11. The scaffolding kit of claim 10, wherein the upper section is hingeably mounted onto the lower section so as to enable folding of the upper section against the lower section and reducing a height of the handrails.

12. The scaffolding kit of claim 11, wherein the platform member includes a working table removably mounting on the handrails when the upper section is folded against the lower section.

13. The scaffolding kit of claim 1, wherein the door opens outwardly from the sleeve member.

* * * * *